US008721135B2

(12) United States Patent
DeRose

(10) Patent No.: US 8,721,135 B2
(45) Date of Patent: May 13, 2014

(54) FLUID COOLED LIGHTING ELEMENT

(76) Inventor: Anthony DeRose, Caledon East (CA)

( * ) Notice: Subject to any disclaimer, the term of this patent is extended or adjusted under 35 U.S.C. 154(b) by 254 days.

(21) Appl. No.: 13/331,514

(22) Filed: Dec. 20, 2011

(65) Prior Publication Data

US 2012/0155094 A1 Jun. 21, 2012

Related U.S. Application Data

(60) Provisional application No. 61/425,737, filed on Dec. 21, 2010.

(51) Int. Cl.
*F21V 29/00* (2006.01)

(52) U.S. Cl.
USPC ..... 362/373; 362/294

(58) Field of Classification Search
USPC ..... 362/294, 373, 580, 547, 126, 218, 264, 362/345, 249.02, 800
See application file for complete search history.

(56) References Cited

U.S. PATENT DOCUMENTS

| | | | | |
|---|---|---|---|---|
| 3,290,539 | A | 12/1966 | LaMorte | |
| 5,005,640 | A | 4/1991 | Lapinski et al. | |
| 5,105,429 | A | 4/1992 | Mundinger et al. | |
| 5,223,747 | A | 6/1993 | Tschulena | |
| 5,262,675 | A | 11/1993 | Bausman, Jr. | |
| 5,751,327 | A | 5/1998 | De Cock et al. | |
| 6,121,995 | A | 9/2000 | Kattner | |
| 6,480,389 | B1 | 11/2002 | Shie et al. | |
| 6,729,383 | B1 * | 5/2004 | Cannell et al. | 165/80.3 |
| 6,780,678 | B2 | 8/2004 | Simon et al. | |
| 7,235,878 | B2 | 6/2007 | Owen et al. | |
| 7,309,145 | B2 * | 12/2007 | Nagata et al. | 362/294 |
| 7,318,660 | B2 | 1/2008 | Yu | |
| 7,505,268 | B2 | 3/2009 | Schick | |
| 7,538,427 | B2 | 5/2009 | Kinoshita et al. | |
| 7,635,204 | B2 | 12/2009 | Yu | |
| 7,757,752 | B2 * | 7/2010 | Egawa et al. | 165/170 |
| 7,780,314 | B2 | 8/2010 | Seabrook | |
| 7,784,972 | B2 | 8/2010 | Heffington et al. | |
| 7,812,365 | B2 | 10/2010 | Murayama | |
| 7,855,449 | B2 | 12/2010 | De Graff et al. | |
| 8,002,443 | B2 * | 8/2011 | Shin et al. | 362/294 |
| 2005/0152146 | A1 | 7/2005 | Owen et al. | |
| 2007/0252268 | A1 | 11/2007 | Chew et al. | |
| 2007/0261830 | A1 * | 11/2007 | Egawa et al. | 165/165 |
| 2008/0170367 | A1 | 7/2008 | Lai | |
| 2009/0059594 | A1 | 3/2009 | Lin | |
| 2010/0177519 | A1 | 7/2010 | Schlitz | |
| 2010/0264826 | A1 | 10/2010 | Yatsuda et al. | |

FOREIGN PATENT DOCUMENTS

| | | |
|---|---|---|
| EP | 2036734 | 3/2009 |

OTHER PUBLICATIONS

A Microjet Array Cooling System for Thermal Management of High Brightness LEDs, IEEE Transactions on Advanced Packaging, vol. 30, No. 3, Aug. 2007.

* cited by examiner

*Primary Examiner* — Bao Q Truong
(74) *Attorney, Agent, or Firm* — Todd J. Langford; Eric A. Hanscom

(57) ABSTRACT

A fluid cooled lighting element is disclosed. A fluid, preferably a liquid, cools and stabilizes the p-n junction of a light emitting diode thereby reducing the energy required to power the light emitting diode, lengthening its usable lifetime, and outputting more consistent light. The fluid can cool a heat sink, printed circuit board, metal plates to which the light emitting diode is mounted, the lens surrounding the light emitting diode, or other heat transferring elements proximate to the light emitting diode.

28 Claims, 10 Drawing Sheets

Fig. 9
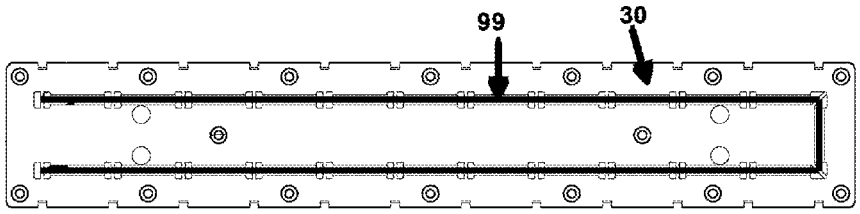
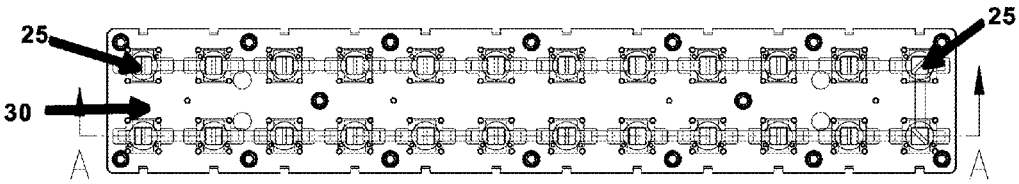
Fig. 10
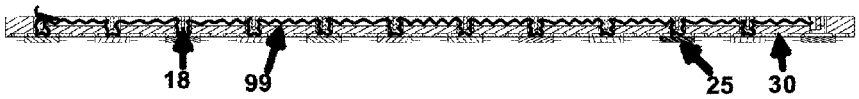
Fig. 11

FLUID COOLED LIGHTING ELEMENT

CROSS REFERENCE TO RELATED APPLICATIONS

This application claims the benefit of U.S. Provisional Patent Application No. 61/425,737 filed on Dec. 21, 2010, the entirety of which is hereby incorporated by reference.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of light emitting diodes, and more specifically toward fluid cooled lighting elements. A fluid, preferably a liquid, cools and stabilizes the p-n junction of the light emitting diode thereby reducing the energy required to power the light emitting diode, lengthening its usable lifetime, and outputting more consistent light. The fluid can cool a heat sink, printed circuit board, metal plates to which the light emitting diode is mounted, the lens surrounding the light emitting diode, or other heat transferring elements proximate to the light emitting diode.

A light emitting diode, or LED, is preferable over a florescent or incandescent light bulb. LEDs require less power to produce the same amount of light as florescent or incandescent light bulbs. Further, LED lights have extremely long life spans, and do not contain mercury. LEDs are prime candidates for many applications requiring sources of light.

An LED is a light-producing object that produces light by passing electricity through a p-n junction biased in the forward direction. A plastic lens surrounds the diode to protect it. The light leaves the diode and travels through the plastic lens where it exits the LED light bulb. The process of creating light from the diode also produces heat.

High lumen LEDs, also known as high power LEDs, are light emitting diodes that can produce upwards of 100 lumens/watt or more. These high lumen LEDs also require more current to run, needing as much as 380 mA for a single 1 watt LED. Some multi-chip LEDs require 3 A or more to run the module.

The amount of heat produced by the LED increases as the current running through the LED increases. The temperature of the p-n junction has a significant effect on the light output of the LED, especially at higher temperatures. Higher temperatures require more current to produce the same output of light. Of course, as more current flows through the LED, even more heat is generated thus continuing to raise the temperature and requiring even more current. Damage to the LED can occur if the temperature of the p-n junction exceeds sixty degrees centigrade (60° C.). Thus, it is imperative to maintain the temperature of the p-n junction of an LED below 60° C.

Heat sinks have been employed to maintain stable temperatures within an LED. These heat sinks are generally extruded metal with fins that transfer heat from the LED to a surrounding medium. They can be large and bulky. Heat sinks cannot be encapsulated because the heat must be released to an external medium, usually air. Since heat rises, a heat sink cannot be located below the LED, as the heat emitted from the heat sink would fall incident to the LED once again. Therefore, the heat sink is preferably located above the LED, thereby limiting the orientation and physical locations in which LEDs can be used, especially high lumen LEDs.

When multiple LEDs are placed in close proximity to each other on a printed circuit board (PC board), heat can build up even faster. Larger heat sinks may be incorporated into the design; however, there is generally a limit on the size of the heat sinks and the amount of heat that can be dissipated by means of the heat sink. This limits the density of LEDs.

Thus there has existed a long-felt need for light emitting diodes, particularly high lumen light emitting diodes, that emit light at a high lumen to watt ratio while maintaining a p-n junction temperature of below 60° C.

SUMMARY OF THE INVENTION

The current invention provides just such a solution by having a fluid cooled light emitting diode. A fluid, preferably a liquid, cools and stabilizes the p-n junction of the light emitting diode thereby reducing the energy required to power the light emitting diode, lengthening its usable lifetime, and outputting more consistent light. The fluid can cool a heat sink, printed circuit board, metal plates to which the light emitting diode is mounted, the lens surrounding the light emitting diode, or other heat transferring elements proximate to the light emitting diode.

While the fluid cools the light emitting diode, it can simultaneously perform other functions. Fluid that has been heated by the LED can be transferred to another location to dissipate the heat it contains. For example, LEDs used to light the exterior of a building or complex can transfer heat to a liquid flowing therethrough, where the liquid then flows to the building and is then used to heat the building.

The fluid can also be used to power the LED. Fluid under pressure can be used to turn a turbine integrated into the pipe that supplies the fluid to the LED. The fluid flows through a turbine, which creates an electrical current that powers the LED. The heat created by the LED is also transferred to the fluid as it passes therethrough. This has particular advantages where there is an ample supply of a fluid already under pressure, such as near dams, rivers, and ocean currents.

It is a principal object of the invention to provide a means for cooling the p-n junction of a light emitting diode.

It is another object of the invention to provide a means for stabilizing the temperature of the p-n junction of a light emitting diode.

It is a further object of this invention to provide a means for powering a light emitting diode using a fluid flowing through or around the light emitting diode.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

FIG. 9 is a bottom cross-sectional view of a mounting plate for cooling multiple LEDs.

FIG. 10 is a top view of the mounting plate for cooling multiple LEDs.

FIG. 11 is a cross-sectional side view of the mounting plate for cooling multiple LEDs.

DETAILED DESCRIPTION OF THE INVENTION

Figure 1:
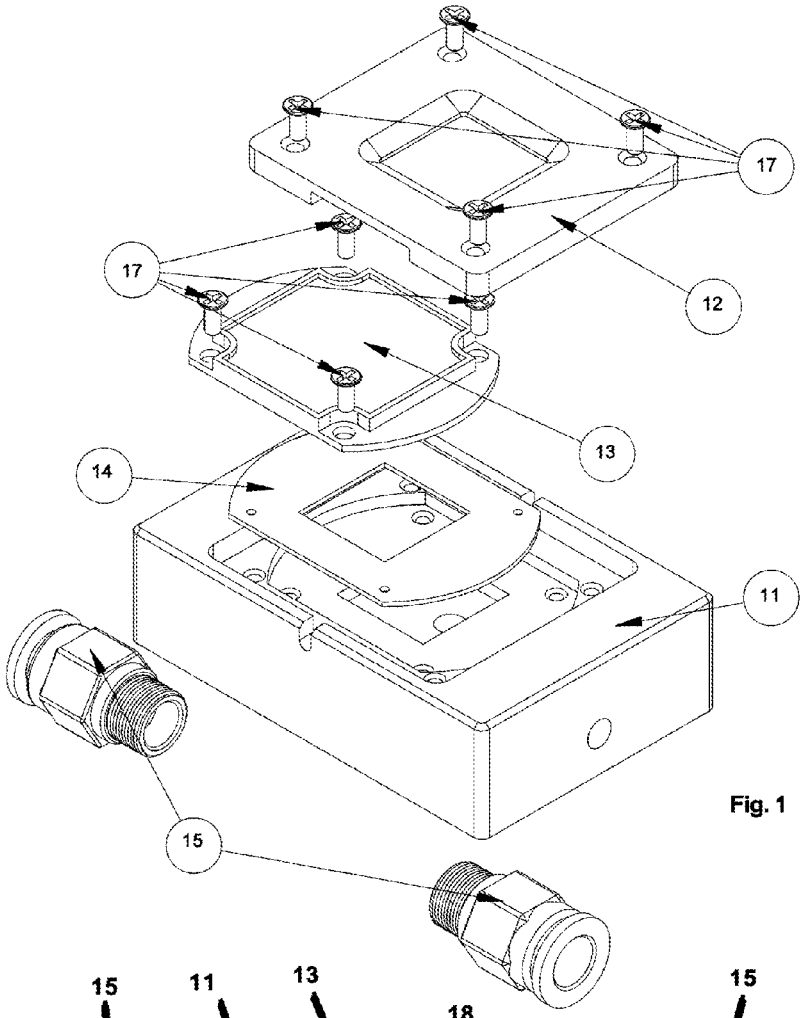
FIG. 1 is an exploded perspective view of a single chip fluid cooled LED light.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is an exploded perspective view of a single chip fluid cooled LED light. An aluminum housing 11 is provided to support the light emitting diode and direct the fluid to cool the light emitting diode. Fluid connectors 15 are used to operably connect a fluid source to the aluminum housing 11. An LED board 13 is secured to the aluminum housing 11 using four screws 17. A silicon seal 14 is placed between the LED board 13 and aluminum housing 11 to provide a watertight seal between the LED board 13 and the aluminum housing 11. The LED board 13 is protected by an aluminum housing cap 12, where the aluminum housing cap 12 is secured to the aluminum housing 11 by screws 17.

Figure 2:
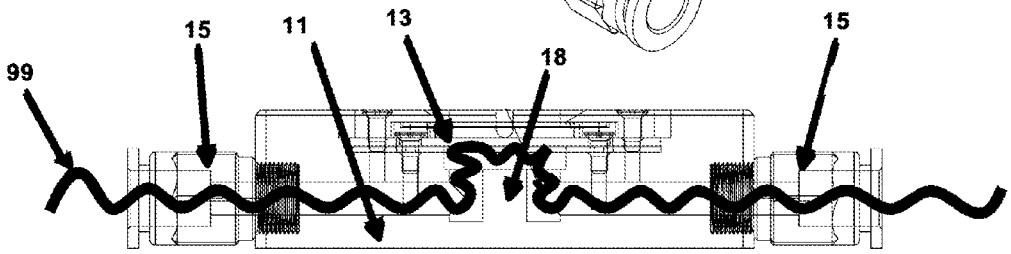
FIG. 2 is a cross-sectional side view of a fluid cooled LED light showing fluid flowing therethrough.

FIG. 2 is a cross-sectional side view of a fluid cooled LED light showing fluid flowing therethrough. Fluid 99 flows through a first fluid connector 15 into the aluminum housing 11. After entering the aluminum housing 11, the fluid 99 encounters an obstruction 18 thereby directing the flow of the fluid upwards towards the LED board 13. Heat is transferred from the LED board 13 to the fluid, thereby cooling the LED, specifically the p-n junction of the LED. The fluid then flows around to the opposite side of the obstruction 18 and out of the aluminum housing 11 through a second fluid connector 15. In this manner, heat is removed from the LED and is added to the fluid.

Figure 3:
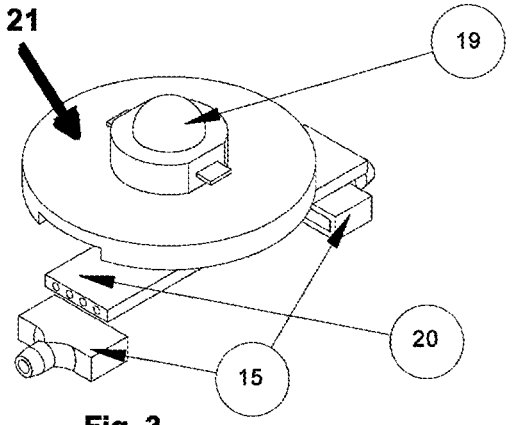
FIG. 3 is an exploded perspective view of a fluid cooled LED light with a channel board.

FIG. 3 is an exploded perspective view of fluid cooled LED light with a channel board. An LED board 13 includes a lens 19 that protects the light emitting diode. The LED board 13 is affixed to a channel board 21. Heat produced by the LED is transferred to the LED board 13, which in turn is transferred to the channel board 21. The channel board 21 then transfers heat to a cooling strip 20. Fluid is supplied to the cooling strip 20 through a first fluid connector 15. Heat is then transferred to the fluid from the cooling strip 20, and then exits the cooling strip 20 through a second fluid connector 15. Preferably, the cooling strip 20 includes a plurality of tubes through which the fluid may travel.

Figure 4:
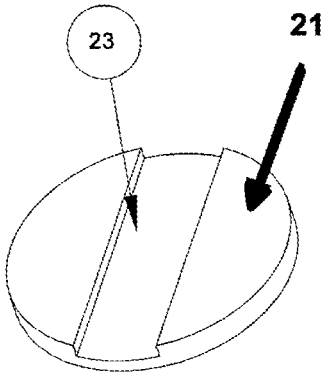
FIG. 4 is a back perspective view of the channel board.

FIG. 4 is a back perspective view of the channel board. To improve heat transfer from the channel board 21 to the cooling strip 20, the channel board 21 includes a channel 23. The channel 23 is of a size and shape to mate with the cooling strip 20, whereby substantially all, if not all, of the surface area of the channel 23 comes in contact with portions of the cooling strip 20.

Figure 5:
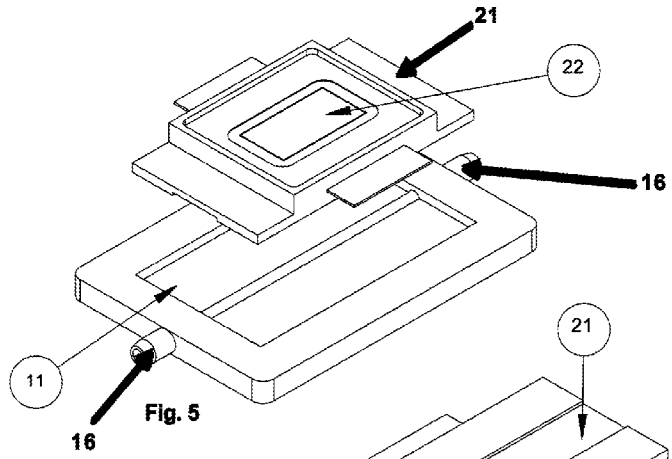
FIG. 5 is an exploded perspective view of an alternative embodiment of a fluid cooled LED light with a channel board.

FIG. 5 is an exploded perspective view of an alternative embodiment of a fluid cooled LED light with a channel board. A multi-chip LED board 22 is affixed to a channel board 21. The multi-chip LED board 22 includes a plurality of LED chips, possibly a plurality of colored LED chips. This allows a variety of colors to be produced by a single light and/or more light to emit from the LED light. The channel board 21 is designed to mate with an aluminum housing 11. In this embodiment, the aluminum housing 11 has two integrated fluid connectors 16, whereby fluid is transferred through a first integrated fluid connector 16, through the aluminum housing 11, and out a second fluid connector 16. The aluminum housing also includes a tube, which travels from one integrated fluid connector 16 to the other integrated fluid connector 16. Fluid travels through the tube, wherein heat is transferred from the aluminum housing to the fluid.

Figure 6:
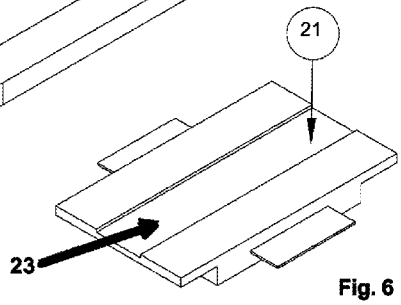
FIG. 6 is a back perspective view of the channel board.

FIG. 6 is a back perspective view of the channel board. The channel board 21 includes a channel 23 to provide space for protrusions, such as a tube, extending from the aluminum housing.

Figure 7:
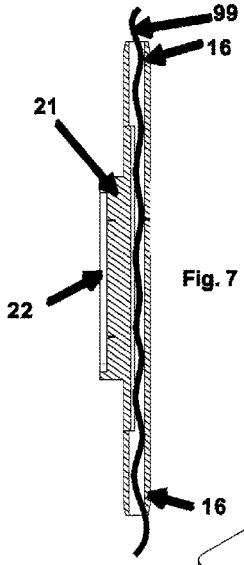
FIG. 7 is a cross-sectional side view of the fluid cooled LED light with a channel board.

FIG. 7 is a cross-sectional side view of the fluid cooled LED light with a channel board. While in operation, fluid 99 travels through a first integrated fluid connector 16, through the aluminum housing 11, and through a second integrated fluid connector 16. Heat generated from the multi-chip LED board 22 is transferred to the channel board 21. Heat from the channel board 21 is then transferred to the aluminum housing 11, which then heats fluid 99 travelling therethrough.

Figure 8:
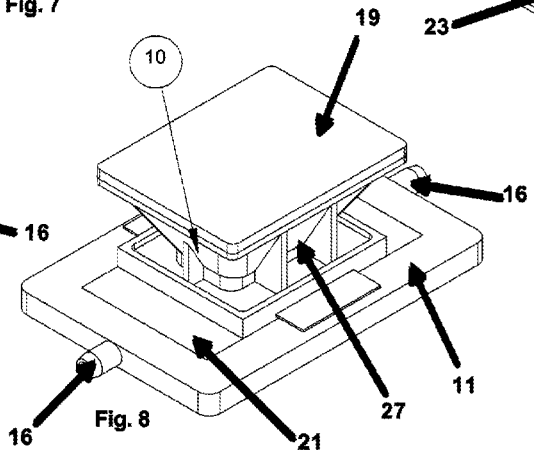
FIG. 8 is a perspective view of the fluid cooled LED light.

FIG. 8 is a perspective view of the fluid cooled LED light. The fluid cooled LED light also includes a cup 27 to direct the emission of light as well as a lens 19 to protect the multi-chip LED board.

FIG. 9 is a bottom cross-sectional view of a mounting plate for cooling multiple LEDs. Fluid 99 enters a first end of a mounting plate 30 through an opening. The fluid 99 then travels down the length of mounting plate 30 on one side, traverses the mounting plate at the opposing end, and then travels back down the length of the mounting plate 30. The fluid 99 then exits the first end of the mounting plate 30 through a second opening.

FIG. 10 is a top view of the mounting plate for cooling multiple LEDs. A plurality of LEDs 25 are affixed to the mounting plate 30. Preferably, the LEDs 25 are placed over the same location that the fluid passes through the mounting plate, thereby providing the shortest distance between the LED 25 and the fluid to provide an efficient means of transferring heat from the LED 25 to the fluid.

FIG. 11 is a cross-sectional side view of the mounting plate for cooling multiple LEDs taken along the line A-A of FIG. 10. The fluid 99 flows into the mounting plate 30 at one end. An obstruction 18 is positioned in the path of the flow of the fluid 99 thereby directing it towards the LED 25 that is affixed to the mounting plate 30. A pool of fluid is formed above the obstruction and below the LED 25, wherein heat is transferred from the LED to the fluid. The fluid 99 then flows away from the LED 25, travelling in a path around the obstruction 18. The fluid 99 continues down the length of the mounting plate until it reaches the next obstruction 18, wherein the fluid 99 travels around the obstruction and proximate to the LED 25.

Figure 12:
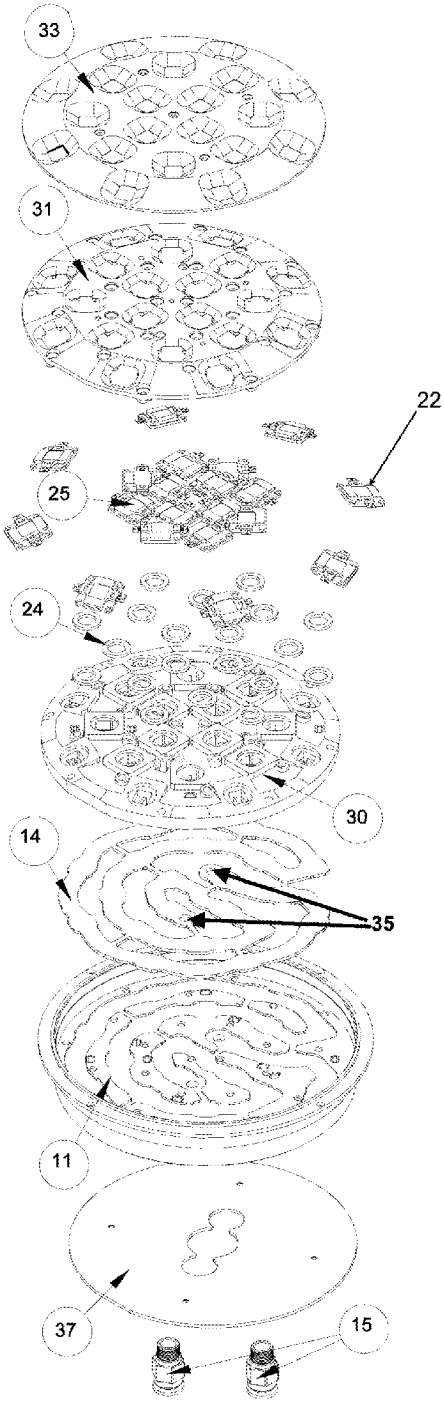
FIG. 12 is an exploded perspective view of a fluid cooled LED light with multiple LEDs.

FIG. 12 is an exploded perspective view of a fluid cooled LED light with multiple LEDs. A circular mounting plate 30 supports a plurality of LEDs 25. The LEDs 25 are preferably secured to LED chip boards 22, which in turn are secured to the mounting plate 30 by screws, though other means are possible, such as pressure fit, snaps, or adhesives. A mounting cover 31 is then secured over the LEDs 25 to the mounting plate 30. An integrated lens cover 33 is then secured to the mounting cover 31 to protect the LEDs 25 and mounting cover 31.

Figure 13:
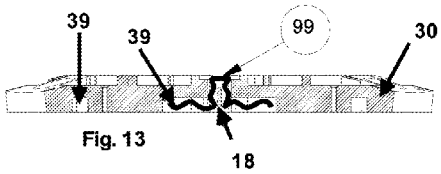
FIG. 13 is a cross section side view of a mounting plate for multiple LEDs.
Figure 14:
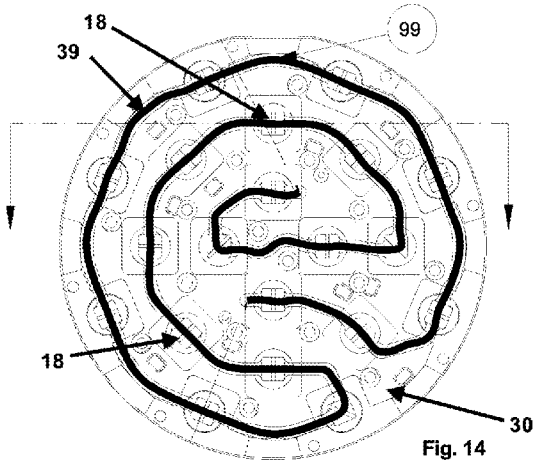
FIG. 14 is a top view of the mounting plate.

Fluid flows through a channel in the underside of the mounting plate 30, shown in more detail in FIGS. 13 and 14. The mounting plate 30 is secured to an aluminum housing 11. A silicon seal 14 resides between the mounting plate 30 and the aluminum housing 11 and creates a fluid-tight seal between the silicon seal 14 and the mounting plate 30. Openings 35 in the silicon seal 14 allow fluid to flow therethrough and into the channel of the underside of the mounting plate 30. A gasket 37 is attached to the aluminum housing 11 and creates a seal between the aluminum housing 11 and two fluid connectors 15. Fluid flows through one of the fluid connectors 15, through the aluminum housing 11 and into the channel of the mounting plate 30. After travelling through the length of the channel of the mounting plate 30, the fluid flows back through the aluminum housing 11 and through the other fluid connector 15.

FIG. 13 is a cross section side view of a mounting plate for multiple LEDs. The mounting plate 30 includes channels 39 through which fluid 99 may flow. The fluid 99 flows around obstructions 18 within the channel 39, whereby the obstruction 18 forces the fluid 99 up toward an LED (not shown in this figure). The fluid 99 then pools above the obstruction 18 wherein heat is transferred from the LED to the fluid. The fluid 99 then travels down the opposite side of the obstruction 18 and back into the channel 39.

FIG. 14 is a bottom view of a mounting plate. The mounting plate 30 includes a channel 39. Fluid flows through the channel 39 to cool the mounting plate 30 and/or LEDs mounted to the mounting plate 30. Fluid flows around obstructions 18 in the channel 39 thereby directing the fluid to contact the LED Body and/or PC board mounted on the mounting plate 30. In an alternative embodiment, the mounting plate 30 itself is a PC board.

Figure 15:
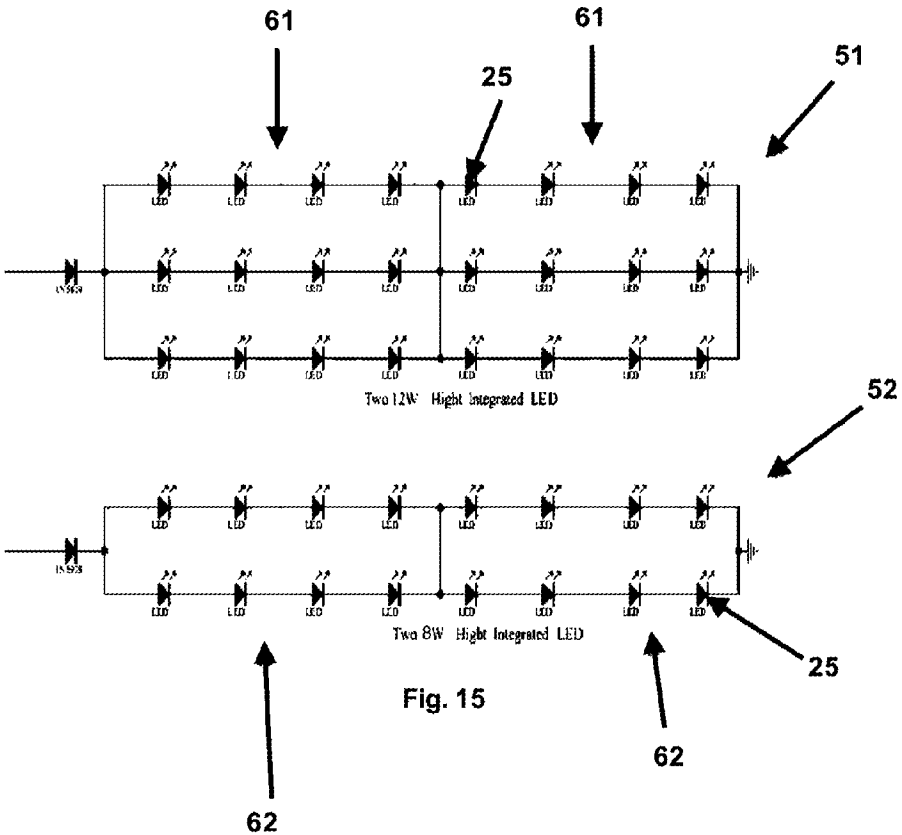
FIG. 15 is a circuit diagram of two high lumen LED lights.

FIG. 15 is a circuit diagram of two high lumen LED lights. The first circuit 51 and the second circuit 52 are each powered by a twenty-four Volt (24V) direct current (DC) source. Looking at the first circuit 51, there are two twelve Watt (12 W) LED groups 61 wired together in series. Each 12 W group 61 includes three sets of LEDs in parallel, where each set of LEDs includes four LEDs in series. Each of the LEDs has a peak operating voltage of 3.4V to 3.6V. Each set of LEDs in series draws current at 240 to 250 Milliampere (mA). By grouping the sets of LEDs together into a group, the voltage across the 12 W group 61 is maintained at 12V. As shown in the first circuit 51, two 12 W LED groups are in series, each with an operating voltage of 12V, to work with a 24V power source. In this same manner, higher voltage sources may be achieved in multiples of 12V. For example, fifty 12 W LED groups may be wired in series for a 600V power source.

The second circuit 52 is substantially similar to the first circuit 51, except that it uses two 8 W LED groups 62 in series. As with the 12 W group 61, each 8 W LED group operates at 12V, but has two sets of LEDs in parallel, each set having four LEDs in series.

Figure 16:
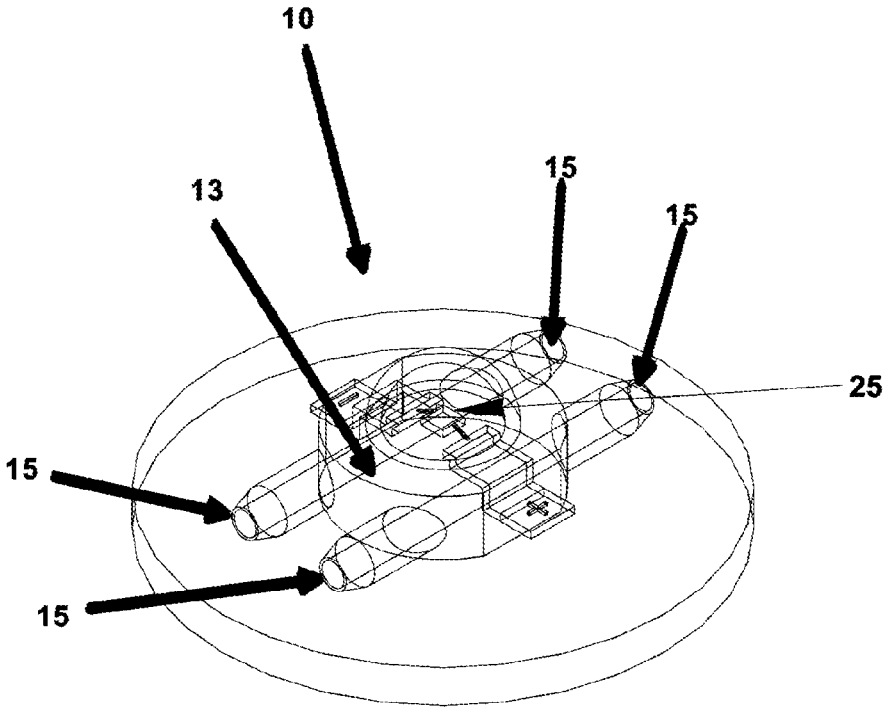
FIG. 16 is a perspective view of an alternative embodiment of a single-chip fluid cooled LED light.

FIG. 16 is a perspective view of an alternative embodiment of a single-chip fluid cooled LED light. In this embodiment, fluid cools the PC board of a fluid cooled LED light 10. Fluid flows through the LED board 13, also known as a PC board, by entering through a first fluid connector 15 and exiting out of a second fluid connector 15. The fluid cools the PC board which has an LED 25 affixed thereto.

Figure 17:
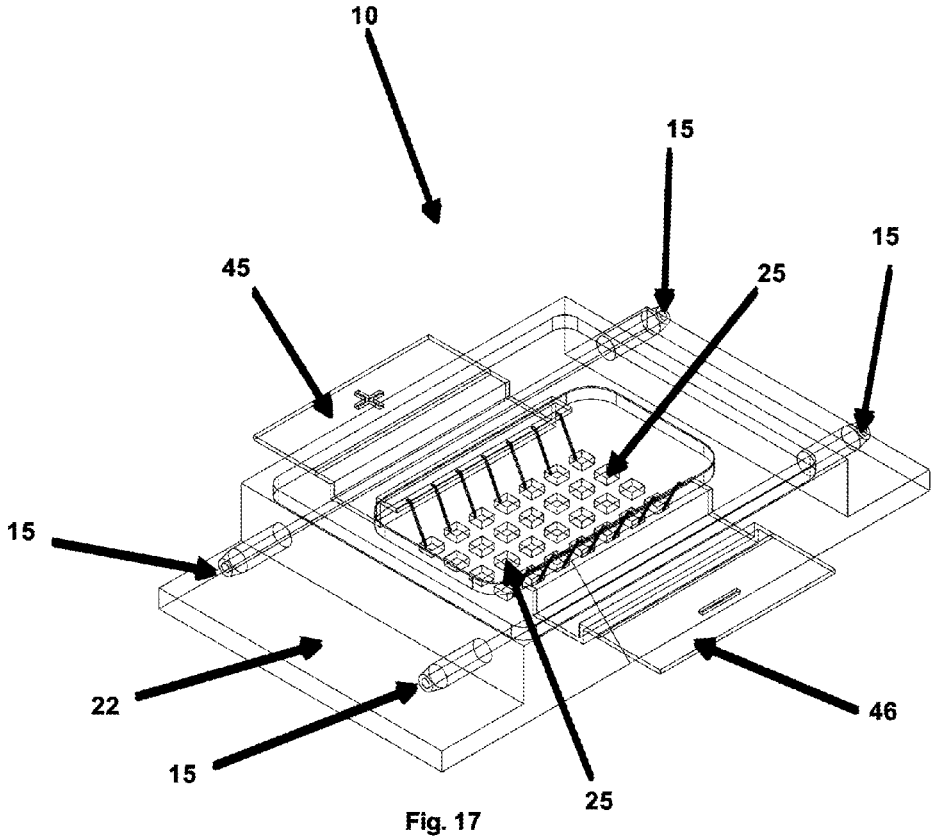
FIG. 17 is a perspective view of an alternative embodiment of a multi-chip fluid cooled LED light.
Figure 18:
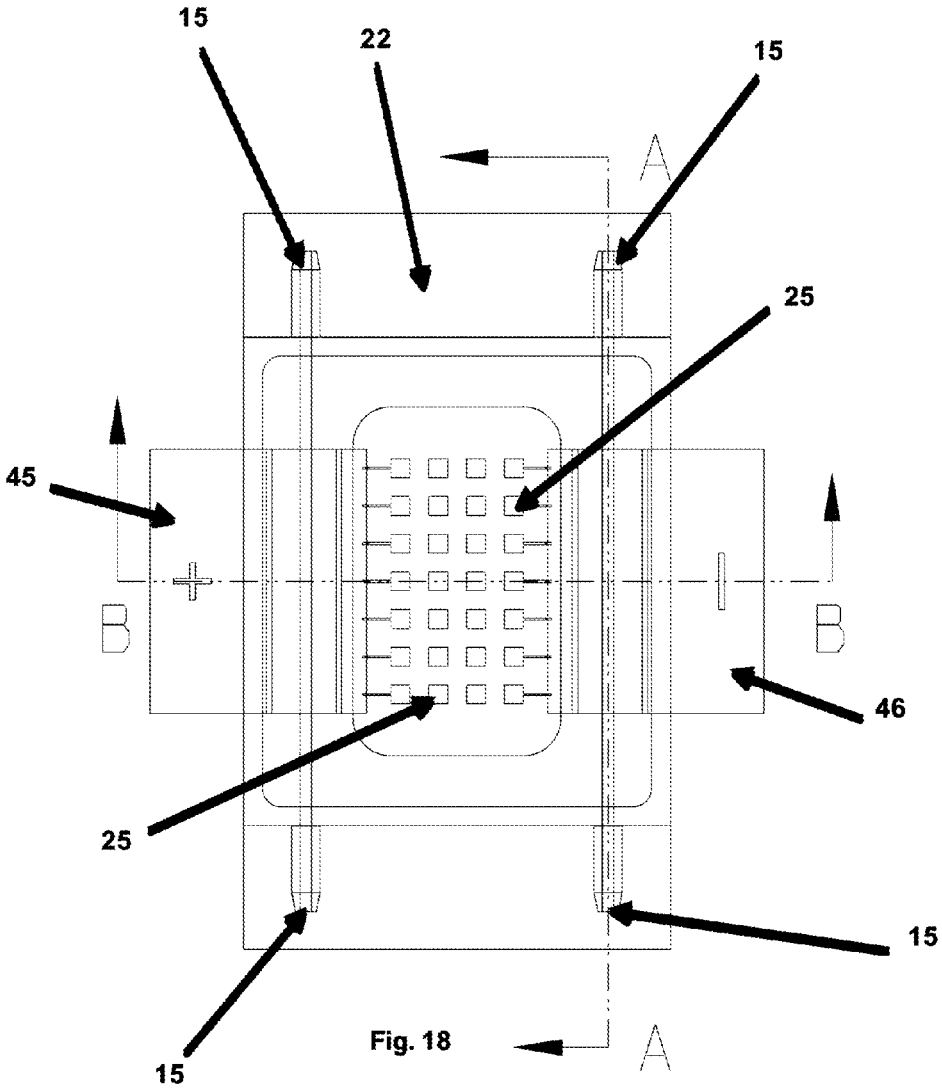
FIG. 18 is a top view of the multi-chip fluid cooled LED light.

FIG. 17 is a perspective view of an alternative embodiment of a multi-chip fluid cooled LED light. FIG. 18 is a top view of the multi-ship fluid cooled LED light. The fluid cooled LED light 10 includes a plurality of LEDs 25. These LEDs are affixed to a multi-chip LED board 22, which includes fluid connectors 15 for transporting fluid therethrough. A positive terminal 45 and negative terminal 46 are used to supply electrical power to the LEDs 25.

Figure 19:
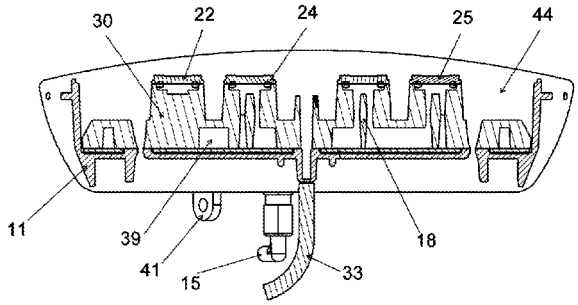
FIG. 19 is a cutaway side view of a fluid cooled LED lighting element according to selected embodiments of the current disclosure.

FIG. 19 is a cutaway side view of a fluid cooled LED lighting element according to selected embodiments of the current disclosure. The mounting plate 30 includes the channels 39 instead of the aluminum housing 11. The aluminum housing 11, silicon seal 14, mounting plate 30, o-ring 24, and LED chip boards 22 are all encapsulated with an epoxy resin 44. Conduit 33 houses electrical wires that provide power to the LEDs 25. Fluid connector 15 provides an access point whereby fluid may travel into the LED lighting element and through the channels 39 in the mounting plate 30. In this manner, fluid, such as water, cools the LED chip boards 22 and transports heat away from the lighting element. Bracket 41, affixed to the aluminum housing, provides a means to mount the LED lighting element to a fixed object, such as a wall or ceiling. In fact, the bracket may be a ceiling mount, wall mount, pole mount, or hanging mount. In this particular embodiment, the fluid passes by each LED chip board 22 in series, meaning that fluid will pass by each LED chip board in the lighting element one at a time.

Figure 20:
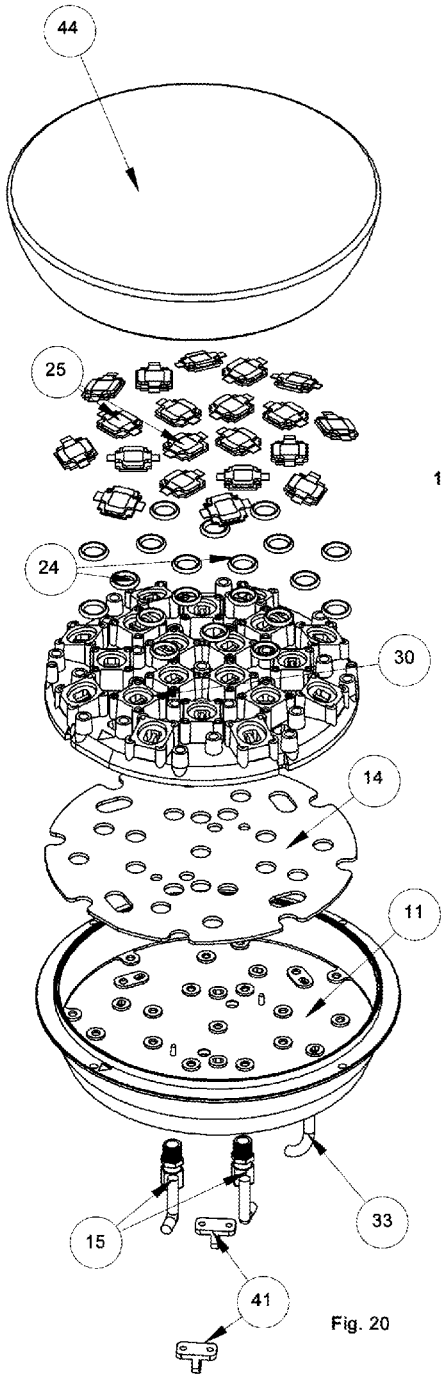
FIG. 20 is an exploded perspective view of a fluid cooled LED lighting element according to selected embodiments of the current disclosure.

FIG. 20 is an exploded perspective view of a fluid cooled LED lighting element according to selected embodiments of the current disclosure. Fluid connectors 15 connect to the aluminum housing 11 to provide fluid to the lighting element. Brackets 41 are also secured to the aluminum housing, whereby the lighting element may be affixed to another surface or object by means of these brackets. Conduit 33 houses electrical wiring that provides electrical power to the LEDs 25 of the lighting element. A silicon seal 14 provides a fluid-tight seal between the aluminum housing 11 and the mounting plate 30. The mounting plate 30 provides attachment points for the LED chip boards 22 and includes channels (not shown in this figure) wherein fluid from the fluid connectors 15 flows therethrough. LED chip boards 22, which each include a plurality of LEDs 25, are mounted to the mounting plate 30 with o-rings 24 to provide fluid-tight connections for the fluid to travel through the mounting plate 30 and come in contact with the back side of the LED chip boards 22. After the LED chip boards 22 are mounted to the mounting plate 30 and the mounting plate 30 is secured to the aluminum housing 11, the entire lighting element is enclosed within an epoxy resin 44. The epoxy resin protects the lighting element from dust, water, and other contaminants. Furthermore, it encapsulates the electrical connections therein to provide insulated connections between the power source provided through the conduit and each of the individual LEDs.

Fluid travelling through the LED lighting element can be provided at various flow rates. However, it has been found that even extremely low flow rates provide sufficient cooling to maintain appropriate p-n junction temperatures within the LEDs. As such, flow rates of 100 mL/min are possible and preferable. Such flow rates provide sufficient cooling without requiring excessive power requirements to maintain the flow of the fluid.

Significant decreases in power consumption are achieved through the use of the current invention. To exemplify this savings, various test have been performed on multiple different configurations.

For example, one lighting unit according to the current invention included twenty LED modules, each with eight 1 W chips, thereby totaling 160 W per lighting unit. The unit was powered by a 24 V source and the ambient temperature was 25° C. No fluid was run through the lighting element. At startup, the lighting unit was drawing 1,050 mA of power. After thirty minutes, the lighting unit was drawing 1,320 mA. Fifty-five minutes after startup, the lighting unit was drawing 1,390 mA and the junction temperature of one of the LEDs was measured at 83° C. Finally, within sixty-eight minutes of startup, the lighting unit was drawing 1,450 mA.

The same 160-Watt lighting unit was then connected to a water source that fed water through the lighting unit at a rate of 67 mL/min. As before, the ambient temperature was 25° C. The water source leading to the lighting unit had a measured temperature of 26° C. At startup, the lighting unit was drawing 1,030 mA of power. After twenty minutes, the lighting unit was still drawing 1,030 mA. At the same time, the water exiting the lighting unit was measured at 27° C. One hour after startup, the lighting unit was still drawing 1,030 mA and the junction temperature of one of the LEDs was measured at 50C.

In another test, a system of four 160 Watt lighting units were put in serial fluid connection, such that the water was fed to a first lighting unit, and then from the first lighting unit to the second lighting unit, and so on through the fourth lighting unit, where the water was then allowed to freely exit the system. Water flowed through the four lighting units at a rate of 58 mL/min. The four units were then connected to a 24 V power source and allowed to operate in a room with an ambient temperature of 27° C. Initially, the entire system was drawing 1860 mA. After twenty minutes, forty minutes, and one hour, the measured power drawn by the system was 1,870 mA. Water entered the system at 28° C. and exited at 29° C. Various LED junction temperatures were measured at a range between 50° C. and 55° C.

An additional test employed a system with three 20-LED chip lighting units in serial fluid connection according to the current invention. A 6 mm outside diameter and 4 mm inside diameter hose was used to feed water to the system as well as transport water from one lighting unit to the next. The total length of hose used was 6 m. Water was fed through the system by means of gravity. A water tank was located 50 cm above the lighting units at a temperature of 27° C., which provided a source of water to the system, and water was allowed to freely exit the system after travelling through the three lighting units. Under such conditions, the system experienced a flow rate of 95 mL/min. The lighting units were connected to a 24 Volt power source. Initially, the system was using 1,870 mA of electricity. After ninety minutes, the system was still drawing only 1,870 mA. The water exiting the system was also measured at 27° C.

A conventional LED lighting unit was also tested, wherein this unit had one-hundred-twelve 1 W LEDs mounted onto a conventional head sink. The lighting unit was connected to a 24 V power supply at an ambient temperature of 29° C. and was initially drawing 1,050 mA. After thirty minutes, the lighting unit was drawing 1,320 mA. After forty-five minutes, this increased to 1,390 mA. After seventy-five minutes, the lighting unit was drawing 1,450 mA and was disconnected to prevent damage to the device.

In yet another test, a 112 W high power LED lighting unit was manufactured according to selected embodiments of the current disclosure. Initially, no fluid of any kind was run through the unit. It was connected to a 24 V power source in an ambient temperature of 29° C. and began using 2,800 mA of electricity. After thirty minutes, the power draw increased to 3,120 mA. After forty-five minutes, the amperage had increased to 3,200 mA. At this point, water was introduced into the lighting unit and allowed to flow therethrough. Within one minute of the water flowing through the lighting unit, the amperage reduced to 3,000 mA. After two minutes, it was 2,980 mA and stayed at this level for at least ten minutes.

This same unit was then disconnected from the power source, and allowed cool off and equalize to the ambient room temperature of 29° C. Water was then run through the lighting unit at a temperature of 28° C. and connected to a 24 V power source. The initial power draw was 2,840 mA. After twenty, thirty, and forty-five minutes, the amperage was measured at 2,840 mA. At this time, water was fed into the lighting unit at a temperature of 20° C. After five minutes of the introduction of 20° C. water, the amperage fell to 2,700 mA. Next, water at 16° C. was fed into the lighting unit, which after forty minutes lowered the amperage to 2,640 mA.

Whenever a pump was required to force water through the lighting unit(s), a LifeTech® AP1200 pump was used. It uses 8.5 W of energy at AC 220-240 V. Such a pump was easily able to provide sufficient flow rate through four 160 W LED lighting units.

As can be seen by the above tests, a low flow rate of 60 mL/min or less can greatly reduce the LED junction temperatures of the lighting unit and thereby greatly decreases the power used by the lighting unit. In fact, the fluid cooled device, as discussed above, may have an energy savings of 28% or more over comparable, non-fluid cooled lighting elements. The extra energy consumed by a small pump is expected to be significantly less than the energy saved by using lighting elements according to the current invention.

Materials referenced herein are for disclosure purposes and could be made from comparable materials. For example, the aluminum housing is preferably made from aluminum, but could be made from other materials such as titanium, steel alloys, porcelain, glass, resins, or thermoplastics. While the current disclosure has particular applicability to high-lumen LEDs, it nonetheless has benefits for any diodes that degrade when subject to high temperatures.

The current invention also has applicability in a wide range of settings. Fluid cooled LEDs according the current invention have beneficial applications in residential commercial, industrial, automotive, aerospace, and any other industries where LEDs are used. Since the heat produced by the LED is drawn away by the fluid, the LED may be operated in a variety of orientations that otherwise would not be possible. For example, the LED may point upwards, whereby heat that would normally rise back into the LED instead is transported away by the fluid.

The fluid is preferably a liquid, and even more preferably water. However, other fluids can be used and may be more preferable in certain settings. For example, air may be used in aircraft or automotive applications. Alcohol based liquids may be used in extreme low temperature applications to prevent freezing of the liquid.

Pressure is required to move the fluid through the structures to cool the junctions of the light emitting diodes. The pressure is generated from various sources, depending upon the application of the fluid cooled LED. For example, in an aircraft setting, the pressure required to move the air through the LED structure may come from external pressure on the aircraft as it travels through the air. In a water vessel setting, the pressure required to move water through the LED structure may come from pressure on the vessel as it travels through the water. Further, the water pressure created from the vessel traveling through the water can also be used to power the LEDs by means of a turbine, explained in more detail below. In another example, a municipal water supply is used to supply the fluid and pressure, wherein the water flows through the LEDs and is discarded into a sewage or grey water system. The current invention has particular benefits where there is already a source of pressurized water, such as swimming pools, water fountains, dams, streams, and rivers. Where no source of pressurized water is readily available, pumps and/or gravity fed systems may be used. For example, a battery, solar, or grid-powered pump may be used to pump water through the LEDs. The fluid may also be gravity fed by means of an above grade holding tank. The fluid may be discarded or returned to the tank by a pump.

While a system and device has been disclosed herein that removes the necessity of a heat sink, it is nonetheless possible and, in some instances, even preferable to incorporate a heat sink. A closed loop fluid system may have a fluid that flows into the aluminum housing of an LED light and proximate to the PC board of an LED, wherein heat is transferred from the LED to the fluid. The fluid then exits the aluminum housing and flows through a heat sink, wherein the heat from the fluid is transferred to the heat sink, and from the heat sink to the environment. This not only has the benefits of fast and efficient heat transfer from the LED to the heat sink, but also allows for the heat sink to be located a relatively large distance away from the LED. This allows for upward lighting LEDs where heat is dissipated away from the LED itself.

In addition or alternatively to the direct cooling of a light emitting diode, the fluid may cool a heat sink that is in thermal contact with the LED. The heat sink may have one or more fins that extend into the flow of the fluid, thereby increasing the surface area of contact between the fluid and the heat sink. This increases the amount of heat that can be transferred from the heat sink to the fluid.

The current invention also allows for a greater number of LEDs to be grouped closer together on the same PC board, as the heat produced from the LEDs can be quickly and efficiently removed. In fact, cool running LEDs use less electricity, have a longer usable lifespan, operating in warmer environments, and require less space. In this same manner, more LED chips can be placed on the same LED mounting plate, and more PC boards may be used in the same LED Light body. In fact, one LED unit with hundreds of LED chips that can produce thousands of lumens can replace many conventional lighting units and require a fraction of the electrical energy required to operate the light.

Fluid may also flow around and through the lens of the LED to cool the LED. In this embodiment, the lens is manufactured with one or more channels travelling therethrough and from a material that is nonreactive with the fluid. Preferably, the material of the lens is highly heat conductive such that heat is easily and efficiently transferred from the LED to the fluid.

In another embodiment of the current invention, the flow of the fluid is used to power the LED. A turbine is integrated into the pipe supplying fluid to the LED light, whereby electricity is generated as fluid flows through the turbine. This electricity is then used to power the LED. The same fluid that passes through the turbine is also used to remove heat from the LED as it produces light. In fact, this can result in a highly efficient process. The heat transferred back to the fluid adds energy to the fluid, and this energy can be once again extracted back into electricity using a turbine.

Heat transferred to the fluid can be discarded, though more preferably the heat is used for one or more other useful purposes. The heated fluid may be routed back through to a building's heat system, whereby the heat produced from the LEDs is used to heat the building. The increased entropy of the fluid may also be extracted in the form of electricity, either from a turbine directly connected to the LED as described above, or in a more consolidated system whereby electricity is produced for another purpose.

In yet another embodiment, there is a single LED unit lighting element that includes a single metal cast molded body. This body is cast molded using a single mold, where the mold has built therein the two fluid connectors (one for inward and one for outward flow of the fluid), channels, and obstructions that direct the fluid flowing through the channel towards the LED chip board. Holes for securing the LED chip board are incorporated therein.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A lighting element comprising a light emitting diode (LED) chip board, and a mounting plate, where the LED chip board is mounted to the mounting plate, where the mounting plate comprises a channel, where the channel comprises an obstruction, whereby fluid flowing through the channel is directed toward and comes in contact with the LED chip board by the obstruction.

2. The lighting element of claim 1, further comprising a silicon seal, wherein the silicon seal creates a fluid tight seal between the mounting plate and the LED chip board.

3. The lighting element of claim 1, wherein the LED chip board comprises an LED.

4. The lighting element of claim 1, further comprising an aluminum housing, wherein the mounting plate is secured to the aluminum housing.

5. The lighting element of claim 4, further comprising a silicon seal, wherein the silicon seal provides a fluid tight seal between the aluminum housing and the mounting plate.

6. The lighting element of claim 4, further comprising a bracket, where the bracket is affixed to the aluminum housing.

7. The lighting element of claim 1, further comprising an epoxy resin, wherein the epoxy resin encapsulates the mounting plate and LED chip board.

8. The lighting element of claim 1, further comprising two fluid connectors, wherein the first fluid connector supplies fluid to the channel, wherein the fluid flowing through the channel exits through the second fluid connector.

9. A lighting element comprising a plurality of light emitting diode (LED) chip boards, and a mounting plate, where each LED chip board is mounted to the mounting plate, where the mounting plate comprises a channel, where the channel comprises a plurality of obstructions, whereby the obstructions cause fluid flowing through the channel to travel toward and come in contact with the LED chip board, by the LED chip board, and then away from the LED chip board and back into the channel.

10. The lighting element of claim 9, wherein the LED chip boards are arranged in series along the channel.

11. The lighting element of claim 9, wherein each LED chip board comprises an LED.

12. The lighting element of claim 9, wherein each LED chip board comprises a plurality of LEDs.

13. The lighting element of claim 9, further comprising a plurality of silicon seals, wherein the silicon seals are secured between the mounting plate and one of the plurality of LED chip boards and create a fluid tight seal between the mounting plate and the LED chip boards.

14. The lighting element of claim 9, further comprising an aluminum housing, wherein the mounting plate is secured to the aluminum housing.

15. The lighting element of claim 14, further comprising a silicon seal, wherein the silicon seal provides a fluid tight seal between the aluminum housing and the mounting plate.

16. The lighting element of claim 14, further comprising an epoxy resin, wherein the epoxy resin encapsulates the mounting plate, aluminum housing and LED chip board.

17. The lighting element of claim 14, further comprising two fluid connectors, wherein the first fluid connector supplies fluid to the channel, wherein the fluid flowing through the channel exits through the second fluid connector, where each fluid connector is secured to the aluminum housing.

18. A method of operating a lighting element comprising the steps of obtaining a lighting element, where the lighting element comprises a light emitting diode (LED) chip board, and a mounting plate, where the LED chip board is mounted to the mounting plate, where the mounting plate comprises a channel, where the channel comprises an obstruction, whereby fluid flowing through the channel is directed toward the LED chip board by the obstruction, providing fluid to the lighting element, wherein fluid flows through the channel, around the obstruction and towards the LED chip board, contacts the LED chip board, and then flows away from the LED chip board and back into the channel.

19. The method of claim 18, wherein fluid is provided at a rate of 100 mL/min or less.

20. The method of claim 18, wherein the fluid is water.

21. The method of claim 18, wherein the fluid pools above the obstruction and below the LED chip board as it travels around the obstruction.

22. A device comprising a metal cast molded body, wherein the body comprises two fluid connectors, a channel, and an obstruction, a light emitting diode (LED) chip board, wherein the LED chip board comprises an LED secured thereto, where the obstruction directs fluid flowing through the channel toward the LED chip board, where the fluid comes in contact with the LED chip board.

23. The device of claim 22, further comprising a plurality of screws, wherein the metal cast molded body comprises a plurality of holes, wherein the plurality of screws secure the LED chip board to the metal cast body, where the plurality of screws mate with the plurality of holes.

24. The device of claim 22, wherein the metal cast molded body comprises a plurality of holes.

25. The device of claim 24, wherein the plurality of holes secure to the metal cast molded body an item selected from the group consisting of a reflector, an optical lens, and a mounting cover.

26. The device of claim 22, further comprising a mount, where the mount is used to secure the device to an object.

27. The device of claim 26, where the mount is selected from the group consisting of a ceiling mount, wall mount, pole mount, and hanging mount.

28. The device of claim 22, further comprising a plurality of LED chip boards, where the LED chip boards are secured to the metal cast molded body.

* * * * *